US006928680B1

(12) United States Patent
Cai et al.

(10) Patent No.: US 6,928,680 B1
(45) Date of Patent: Aug. 16, 2005

(54) DYNAMIC BABY CLEANING AND CHANGING PAD

(75) Inventors: Li Cai, 4407 Trilliam La., Fayetteville, AR (US) 72704; RangLian Yuan, Changzhou (CN)

(73) Assignees: Li Cai, Fayetteville, AR (US); Rang-lian Yuan, Chang zhou (CN)

( * ) Notice: Subject to any disclaimer, the term of this patent is extended or adjusted under 35 U.S.C. 154(b) by 48 days.

(21) Appl. No.: 10/821,066

(22) Filed: Apr. 8, 2004

(51) Int. Cl.[7] ..... A47D 5/00
(52) U.S. Cl. ..... 5/655; 5/928
(58) Field of Search ..... 5/655, 947, 928; 4/443, 446, 572.1, 621, 625, 659; 108/102, 108/137

(56) References Cited

U.S. PATENT DOCUMENTS 3,313,584 A * 4/1967 Rocker ..... 312/201
3,756,680 A * 9/1973 Lerner ..... 312/237
3,777,673 A * 12/1973 Blazey et al. ..... 108/27
3,916,802 A * 11/1975 Virtue et al. ..... 108/27
5,718,011 A * 2/1998 Nogues ..... 5/655
6,219,866 B1 * 4/2001 Pascal ..... 5/655
6,256,803 B1 7/2001 Sauerbrei
6,327,726 B1 12/2001 Weber
6,405,394 B1 6/2002 Rosenberg
6,421,856 B1 * 7/2002 Furnback ..... 5/655

* cited by examiner

*Primary Examiner*—Robert G. Santos

(57) ABSTRACT

This invention relates to a baby cleaning and changing pad. The key components of the product are a soft stationary pad and a soft movable pad. The stationary pad is mounted on a flat; the movable pad can slide on the flat. On both sides of the stationary pad, there are two safety belt holders. On the top of the movable pad, there are two diaper holders. A space appears between the two pads when the movable pad moves away from the stationary pad. When changing baby's diaper, a person mounts a clean diaper on the movable pad, places the baby on the changing pad, buckles up the safety belt, releases the dirty diapers, moves the movable pad away from stationary pad, and throws away the dirty that moves away from baby along with the movable pad. The space between the movable pad and the stationary pad makes baby cleaning much easier. After cleaning, the person pushes the movable pad along with the clean diaper back to the stationary pad. When the two pads are in touch, the clean diaper is under the baby, which allows the person to put the clean diaper on the baby easily.

3 Claims, 4 Drawing Sheets

DYNAMIC BABY CLEANING AND CHANGING PAD

FIELD OF INVENTION

This present invention is directed generally to a baby care product, and more particularly to a dynamic baby cleaning and changing pad that can create a space underneath a baby during the baby cleaning and diaper changing process, and can hold a clean diaper in a desired position during diaper changing process.

BACKGROUND OF INVENTION

Currently, there are many baby changing pads in the market. When using these changing pads, a person has to pull a baby's leg(s) up to remove the dirty diaper, clean baby's stool and urine, and put a new diaper on. If the new diaper is not placed in a desired position in the first attempt, the person has to pull the baby's leg(s) up again to adjust the diaper position. Pulling baby's leg(s) up makes lower part of body higher than top part of the baby, which can result in an infant spilling milk. In addition, lifting baby's leg(s) can make the baby uncomfortable and cause the baby to cry and resist diaper changing, which can prolongs the diaper changing process. For a weaker infant, a lengthy diaper changing process can increase the possibility of catching cold.

In view of the above problems, there is a need for a novel baby cleaning and changing pad to make the process easier and faster.

SUMMARY OF THE INVENTION

The present invention is directed to improving baby cleaning and diaper changing pad. It can make the baby cleaning and diaper changing process easier and faster. It can also make a baby more comfortable, and reduce the possibility of spilling milk and catching cold.

The invention comprises a stationary pad mounted on a support and a movable pad that can slide on the support. On both sides of the stationary pad, there are safety belt and its holders. On the top of the movable pad, there are clean diaper holders. During the diaper changing process, a person attaches a clean diaper to a desired position on the movable pad, places the baby on the dynamic baby cleaning and changing pad, releases the dirty diaper, and moves the movable pad away from the stationary pad. The space created between the stationary pad and the movable pad allows the person to place a water container under the baby to wash the waste away, or simply wipe out the urine and stool underneath the baby. After cleaning, the movable pad, along with the clean diaper, is pushed back to the stationary pad. The clean diaper is then under the baby again, which makes it easier to put the diaper on.

This invention has the following advantages:

1. Because this invention comprises a stationary pad and movable pad, a person can move the movable pad away from the stationary pad during diaper changing process and create an open space underneath the baby. This space not only allows the person to wipe baby waste from underneath, but also to place a water container under the baby for cleaning. Water cleaning is more thorough and comfortable. Since during the cleaning and changing process, the baby's legs curl up, instead of being pulled up, the baby feels more comfortable and does not resist diaper changing.

2. Because a clean diaper is pre-mounted on the movable pad, it can be placed to an ideal place when the movable pad is pushed to touch the stationary pad after baby cleaning. This enables a person quickly puts a clean diaper on the baby, which makes the baby comfortable and reduces the diaper changing time and the chance for a weak baby to catch cold.
3. Using this invention, one does not have to pull the baby's legs up during the cleaning and changing process. Therefore, it reduces possibility for baby to spill milk.
4. The structure of the invention is simple, and the application is easier.

BRIEF DESCRIPTION OF THE DRAWINGS

The invention may be more completely understood in consideration of the following detailed description of drawings.

Figure 1:
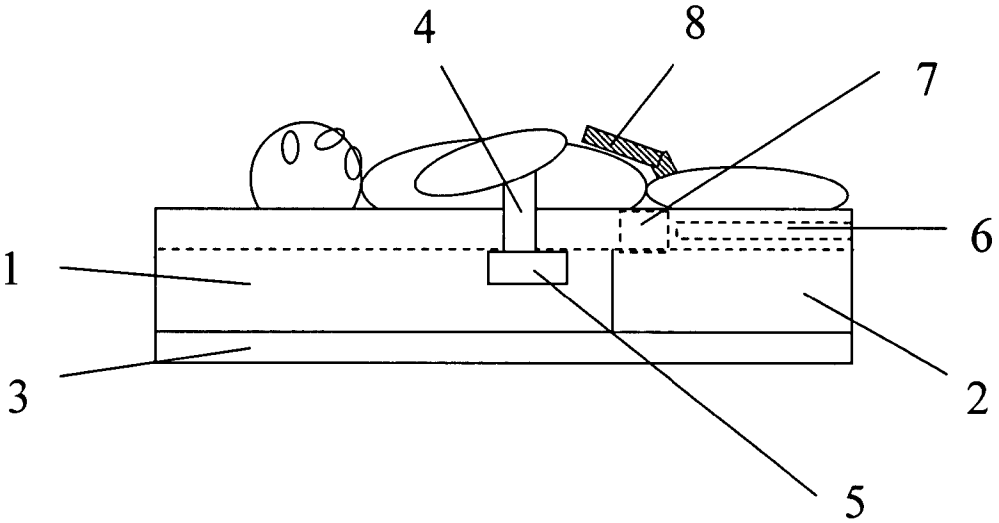
FIG. 1 is a plan view of the dynamic cleaning and changing pad when the stationary pad and movable pad are in touch.
Figure 3:
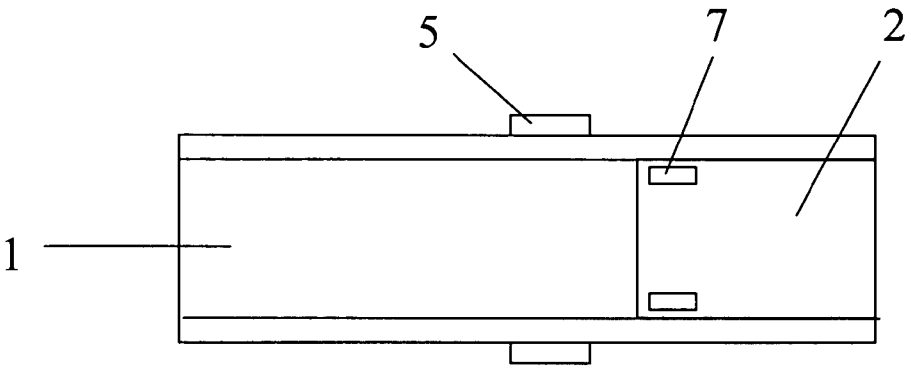
FIG. 3 is a top view of the dynamic cleaning and changing pad shown in FIG. 1.
Figure 2:
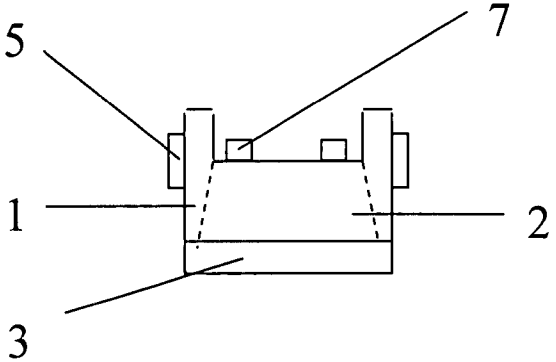
FIG. 2 is a left side view of the dynamic cleaning and changing pad shown in FIG. 1.
Figure 4:
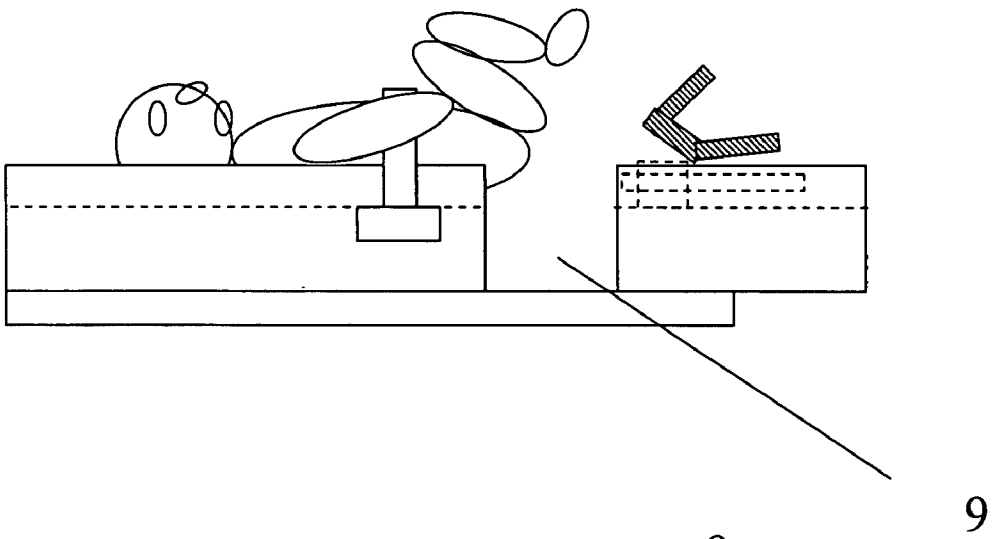
FIG. 4 illustrates the dynamic cleaning and changing pad when the movable pad is pulled away from stationary pad shown in FIG. 1.

In these figures, 1, 10—stationary pads; 2—movable pad; 3—support flat; 4—safety belt; 5—safety belt holders; 6—clean diaper; 7—clean diaper holders; 8—dirty diaper; 9, 9', 9"—spaces between stationary pads and movable pad, 11—water container.

DETAILED DESCRIPTION OF THE INVENTION

First Embodiment

In FIG. 1 to FIG. 4, a stationary pad 1 is mounted on a support 3, and a movable pad 2 is able to slide on the support 3. On both sides of the stationary pad 1 there are safety belts 4 and their holders 5, and on the top of the movable pad 2, there are clean diaper holders 7. A clean diaper 6 can be mounted on the movable pad 2 through the diaper holders 7.

When changing diaper, a person uses the diaper holders 7 to attach a clean diaper 6 on the top of the movable pad 2, places a baby on the stationary pad 1, and puts the safety belts 4 on the baby. The person then releases the dirty diaper from the baby and moves the movable pad 2, along with the dirty diaper 8, away from the stationary pad 1 till a sufficient space 9 is created. Then the person throws the dirty diaper 8 away and cleans the baby with wet wipe or water. After cleaning, the movable pad 2, along with the clean diaper 6, is pushed back towards stationary pad 1 till they touch each other. The person then releases the clean diaper 6 from its holders 7 and puts the diaper 6 on the baby. After that, the person frees the baby from safety belts 4 and takes the baby away from the dynamic cleaning and changing pad.

Second Embodiment

Figure 5:
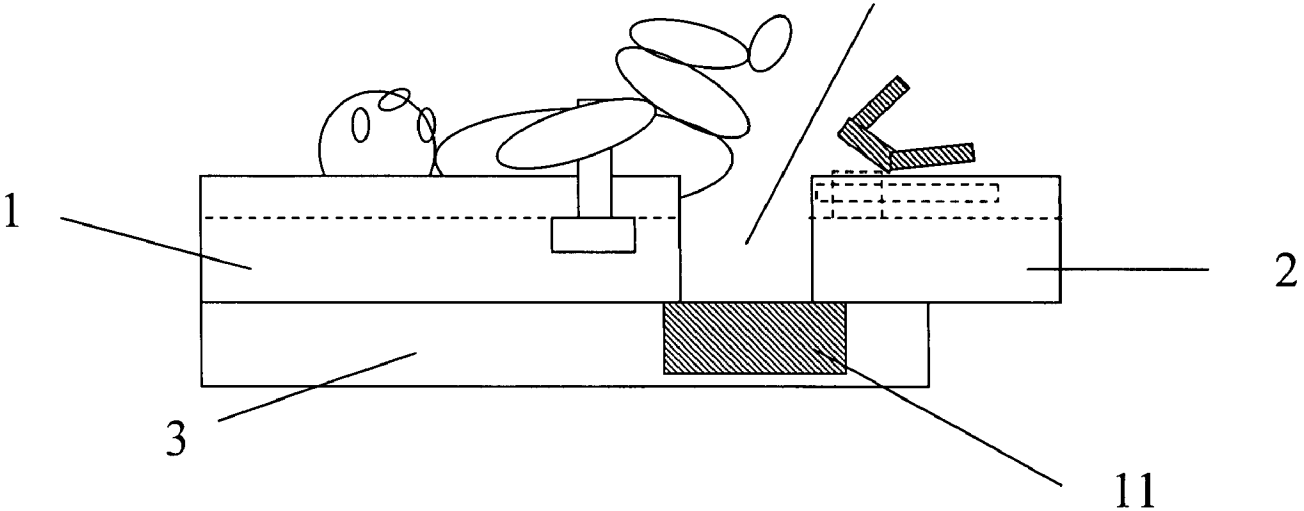
FIG. 5 illustrates another configuration of the dynamic cleaning and changing pad shown in FIG. 1.
Figure 6:
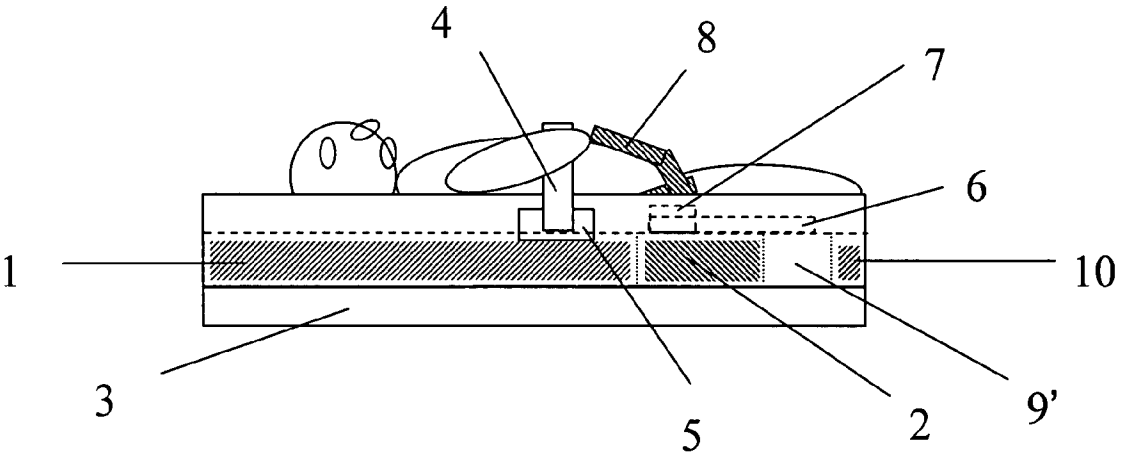
FIG. 6 is a plan view of the dynamic cleaning and changing pad when the movable pad is away from the right stationary pad and is in touch with the left stationary pad.
Figure 8:
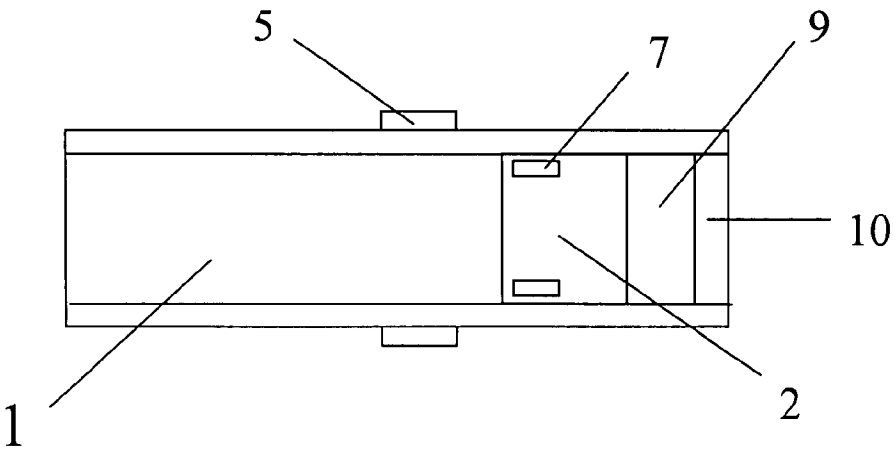
FIG. 8 is a top view of the changing pad shown in FIG. 6.
Figure 7:
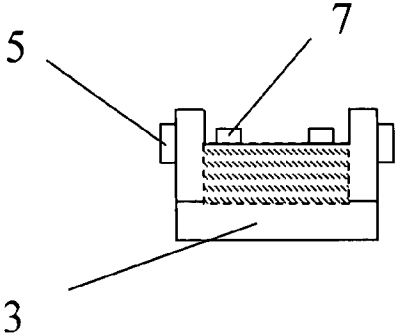
FIG. 7 is a left side view of the changing pad shown in FIG. 6.
Figure 9:
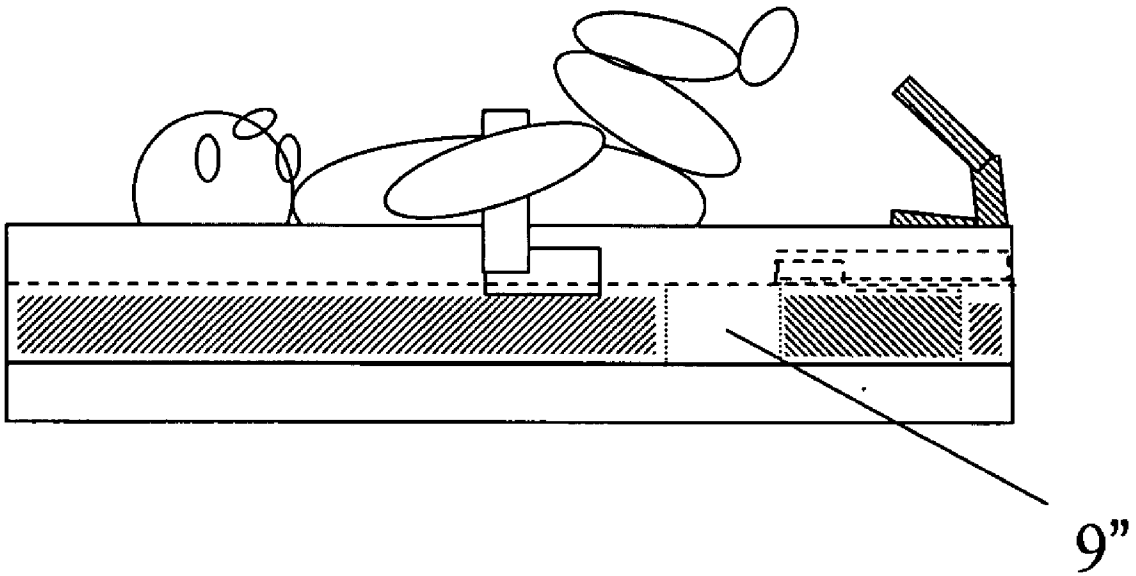
FIG. 9 is a plan view of the changing pad when the right stationary pad and movable pad are in touch.

The dynamic cleaning and changing pad shown in FIG. 5 is similar to the first embodiment expect a water container 11 can be inserted in the support 3. When the movable pad 2 is moved away from the stationary pad 1, the water container 11 appears. A person can add warm water in the container for baby cleaning. After cleaning, the person empties the container 11 and moves the movable pad 2 to the stationary pad 1. The container is then covered by the movable pad 2.

Third Embodiment

In FIG. 6 to FIG. 9, stationary pad 1 and stationary 10 are mounted on a support 3, and a movable pad 2 is able to slide on the support 3, between the stationary pad 1 and stationary 10. On both sides of the stationary pad 1, there are safety belts 4 and their holders 5, and on the top of the movable pad 2, there are clean diaper holders 7. A clean diaper 6 can be mounted on the movable pad 2 through the diaper holders 7.

When changing diaper, a person uses the diaper holders 7 to attach a clean diaper 6 on the top of the movable pad 2, places a baby on the dynamic cleaning and changing pad, and puts the safety belts 4 on the baby. The person then releases the dirty diaper and moves the movable pad 2, along with the dirty diaper 8, away from the stationary pad 1 till the movable pad 2 touches the stationary pad 10. Then the person throws the dirty diaper 8 away and cleans the baby with wet wipe or water. Space 9' is occupied by the movable pad 2. Space 9" between the stationary pad 1 and the movable pad 2 can hold a water container for baby cleaning. After cleaning, the movable pad 2, along with the clean diaper 6, is pushed back towards stationary pad 1 till they touch each other. Space 9" is occupied by the movable pad 2, and space 9' between the movable pad 2 and stationary pad 10 appears again. The person then releases the clean diaper 6 from its holders 7 and puts the diaper 6 on the baby. After that, the person frees the baby from safety belt and takes the baby away from the cleaning and changing pad.

In the above examples, a person does not need to pull baby's leg(s) up. During the cleaning and changing process, the baby curls over naturally. That relaxing horizontal position can reduce the possibility of spill milk. In addition, since the clean diaper 6 is mounted on the movable pad 2 before the baby is placed on the cleaning and changing pad, the clean diaper 6 can be placed in a desired position. Once the movable pad 2 is in touch with stationary pad 1, a person can quickly put the clean diaper 6 on the baby.

We claim:

1. A dynamic baby cleaning and changing pad, comprising: a stationary pad having a top surface, a bottom surface, a pair of opposing side surfaces, a head end and a foot end; a support having a top surface, a bottom surface, a head end and a foot end, wherein said bottom surface of said stationary pad is mounted on said top surface of said support and said head end of said stationary pad is substantially vertically aligned with said head end of said support; a movable pad having a top surface, a bottom surface, a head end and a foot end, wherein said bottom surface of said movable pad can slide on said top surface of the support between a first position wherein said foot end of said stationary pad is contiguous with said head end of said movable pad and said foot end of said movable pad is substantially vertically aligned with said foot end of said support, and a second position wherein said foot end of said stationary pad does not contact said head end of said movable pad and said foot end of said movable pad longitudinally extends past said foot end of said support in order to create a space between the stationary pad and the movable pad; safety belts and their holders, wherein one of the safety belts and one of the holders are attached to one of said side surfaces of said stationary pad and another of the safety belts and another of the holders are attached to the other of said side surfaces of said stationary pad, the safety belts and their holders being situated along a common lateral axis of said stationary pad; and clean diaper holders that attach a clean diaper on said top surface of the movable pad, said clean diaper holders extending upwardly from said top surface of the movable pad.

2. The dynamic baby cleaning and changing pad of claim 1 wherein a water container can be inserted in the support underneath the space.

3. A dynamic baby cleaning and changing pad, comprising: a support having a top surface, a bottom surface, a head end and a foot end; soft pads on the top surface of the support, the soft pads comprise a pair of stationary pads mounted on the support, each said stationary pad having a top surface, a bottom surface, a pair of opposing side surfaces, a head end and a foot end, wherein said head end of one of said stationary pads is substantially vertically aligned with said head end of said support, said foot end of the other of said stationary pads is substantially vertically aligned with said foot end of said support and said stationary pads are longitudinally spaced from each other, and a soft pad that can move between said stationary pads, said soft pad having a top surface, a bottom surface, a head end and a foot end and being movable between a first position wherein the foot end of the stationary pad proximate the head end of the support is contiguous with said head end of said movable pad and said movable pad and the stationary pad proximate the foot end of the support are longitudinally spaced from each other, and a second position wherein the foot end of the movable pad is contiguous with said head end of the stationary pad proximate the foot end of the support and said movable pad and the stationary pad proximate the head end of the support are longitudinally spaced from each other; safety belts and their holders, wherein one of said safety belts and one of said holders are attached to one of said side surfaces of said stationary pad proximate the head end of said support and another of said safety belts and another of said holders are attached to the other of said side surfaces of said stationary pad proximate the head end of said support, said safety belts and their holders being situated along a common lateral axis of said stationary pad proximate the head end of said support; and clean diaper holders that attach a clean diaper on said top surface of the movable pad, said clean diaper holders extending upwardly from said top surface of the movable pad.

* * * * *